US005692976A

United States Patent [19]

Yu

[11] Patent Number: 5,692,976

[45] Date of Patent: Dec. 2, 1997

[54] COLLAPSIBLE SUPPORT UNIT FOR BASKETBALL BASKET

[76] Inventor: Wan-Sheng Yu, P.O. Box 1-79, Taipei, Taiwan

[21] Appl. No.: 743,246

[22] Filed: Nov. 5, 1996

[51] Int. Cl.[6] ..... A63B 69/00

[52] U.S. Cl. ..... 473/433; 273/397

[58] Field of Search ..... 473/433, 481; 273/397; D21/201

[56] References Cited

U.S. PATENT DOCUMENTS

| | | | |
|---|---|---|---|
| D. 321,737 | 11/1991 | Lo | D21/201 |
| 3,901,506 | 8/1975 | Caveney | 473/433 |
| 4,786,371 | 11/1988 | Postol | 473/433 |
| 4,838,549 | 6/1989 | Woodall | 473/433 |
| 5,133,546 | 7/1992 | Matherne et al. | 273/397 X |
| 5,273,275 | 12/1993 | Wilkerson | 473/433 |
| 5,312,099 | 5/1994 | Oliver, Sr. | 473/433 |

*Primary Examiner*—Paul E. Shapiro

*Attorney, Agent, or Firm*—Bacon & Thomas

[57] ABSTRACT

A collapsible support unit for basketball basket which allows the ball to return to the player after a shot is made at the basket so that the player needs not to run about in order to take back the ball after making a shot. It also allows the ball to be confined so that the ball would not do damage to anything or hurt anybody nearby. The collapsible support unit includes a backboard mounted with a basket and a main upright frame for supporting said backboard. A plurality of auxiliary upright frames are arranged in a row with said main upright frame and are collapsible to the upright frame by means of a plurality of extendable linkage units coupled therebetween. Furthermore, an enclosure defined by a net is formed around said basket for confining the ball, and a ball rolling path defined by a flexible piece extends from the bottom of said backboard to the top of the outermost auxiliary upright frame, allowing the bounced ball to roll back to the player. The player can practice making shots continually without having to chase the ball all around the court after one shot is made. When not in use, the collapsible support unit can be collapsed for easy storage.

4 Claims, 4 Drawing Sheets

COLLAPSIBLE SUPPORT UNIT FOR BASKETBALL BASKET

BACKGROUND OF THE INVENTION

1. Field of the Invention

This invention relates to support units for supporting basketball baskets, and more particularly, to a collapsible support unit for supporting a basketball basket which allows a basketball player to practice making shots at the basket at any convenient places.

2. Description of Related Art

Basketball is a game which requires a raised basket as the goal to shoot the ball. In order to attain the goal, to continuously practice training basketball is particularly required. In doing that, it is not only played on a regular basketball court, but can also played in the yard with a basket which is mounted on the wall or supported by a simple movable L-shaped post on the ground. The latter type allows the player to practice playing basketball at home and is quite popular since the baskets on a regular court may not be always available.

It is a drawback to this type of basket that, after making a training shot, the ball could bounce to any directions such that the player usually has to chase the ball around the playground in order to take back the ball, which is quite exhausting and time-wasting. When playing in the yard, the strayed ball could further do damage to the house or garden plants, for example, or do hurt to children or pets, for example. There exists, therefore, a need for a basket support which allows the ball to be confined and also allows the training ball to return to the player after a tracining shot is made.

SUMMARY OF THE INVENTION

It is therefore a primary objective of the present invention to provide a collapsible support unit for basketball basket which allows the ball to return to the player after making a training shot at the basket so that the player needs not to run about in order to take back the ball after making a training shot.

It is another objective of the present invention to provide a collapsible support unit for basketball basket which allows the ball to be confined so that the ball would not bounce to the sides and thus do damage to anything or hurt anybody nearby.

In accordance with the foregoing and other objectives of the present invention, a new and improved collapsible support unit for basketball basket is provided. The collapsible support unit is used to support a backboard mounted with a basket and includes a main upright frame for supporting the backboard and a plurality of auxiliary upright frames arranged in a row with the main upright frame. A plurality of extendable linkage units couple between the main and auxiliary upright frames, each including a first linkage bar and a second linkage bar which are pivotally coupled by means of a pin to each other substantially at the middle point thereof. The first linkage bar has a top end pivotally linked to a fixed position on one of the main and auxiliary upright frames and a bottom end pivotally linked to a sliding tube which sleeves one neighboring upright frame, and similarly the second linkage bar has a top end pivotally linked to a fixed position on the one neighboring upright frame and a bottom end pivotally linked to a sliding tube which sleeves the one of the main and auxiliary upright frames. Furthermore, an enclosure defined by a net is formed around the basket for confining the ball, and a ball rolling path defined by a flexible piece, for example, extends from the bottom of the backboard at a declined angle downward to the top of the outermost auxiliary upright frame, allowing the bounced ball to roll back to the player.

With the foregoing collapsible support unit, the player can practice making training shots continually without having to chase the ball all around the court after one shot is made. When not in use, the collapsible support unit can be collapsed by pushing the outermost auxiliary upright frame toward the main upright frame. In doing this, since the net and the flexible piece are flexible, they can be collapsed along with the auxiliary upright frames without having to remove them first. The collapsible support unit of the present invention is thus not only easy to extend for practice or play, but also easy to collapse for storage.

BRIEF DESCRIPTION OF DRAWINGS

The invention can be more fully understood from the following detailed description of the preferred embodiments, with reference made to the accompanying drawings, wherein.

DETAILED DESCRIPTION OF PREFERRED EMBODIMENT

Figure 1:
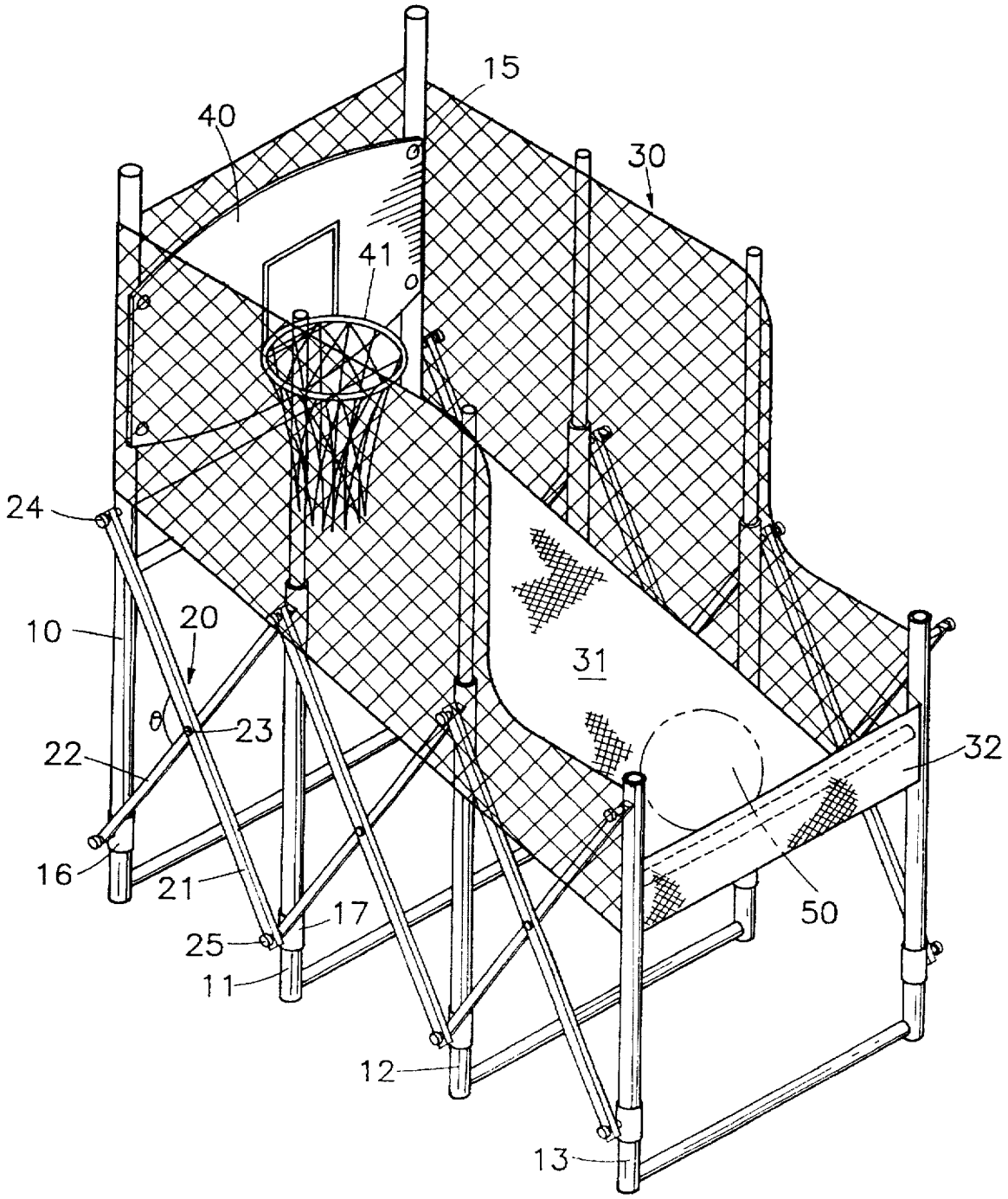
FIG. 1 is a perspective view of the collapsible support unit for basketball basket according to the present invention when it is extended.
Figure 2:
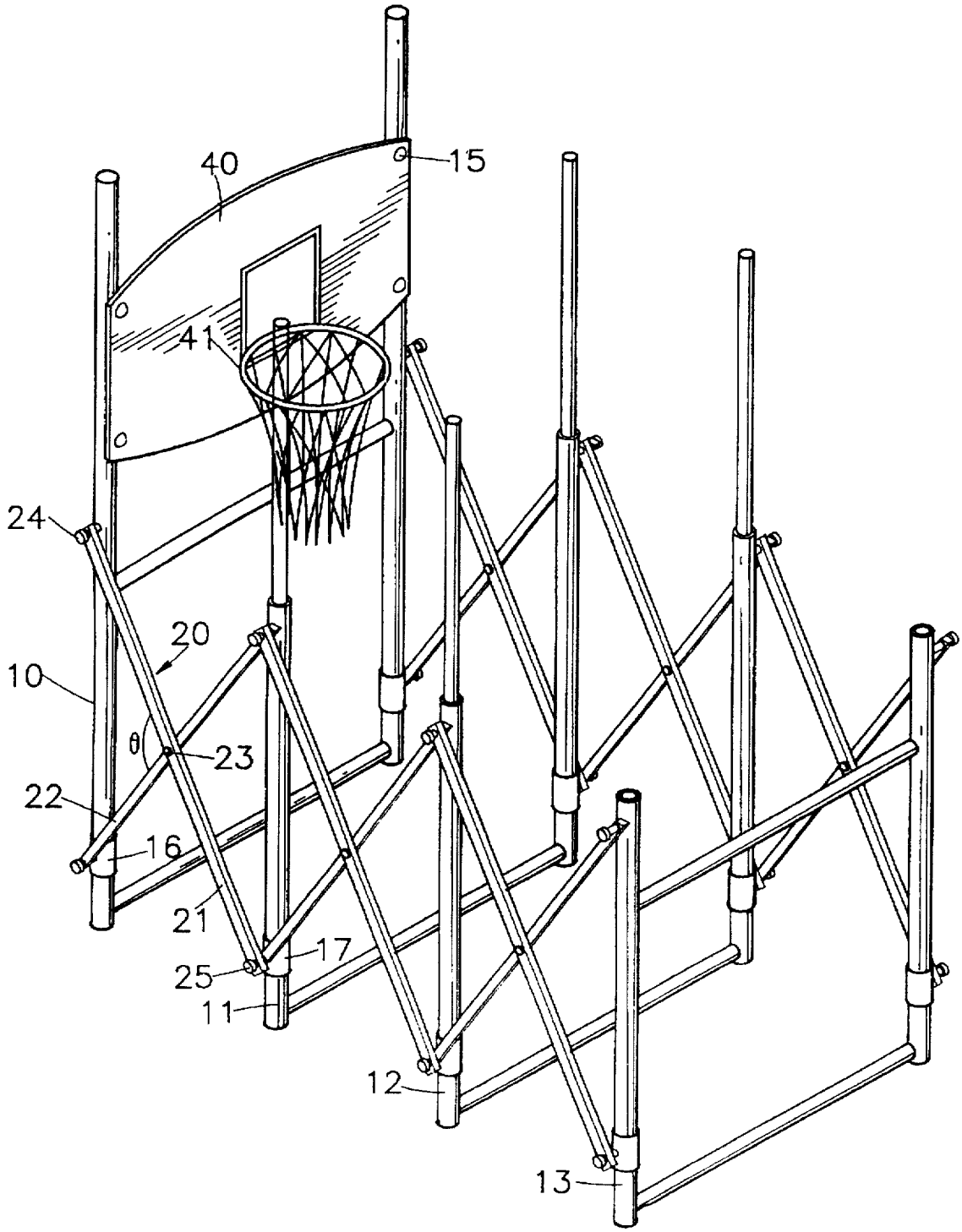
FIG. 2 is a perspective view of the collapsible support unit of FIG. 1 when a net thereon is removed.
Figure 3:
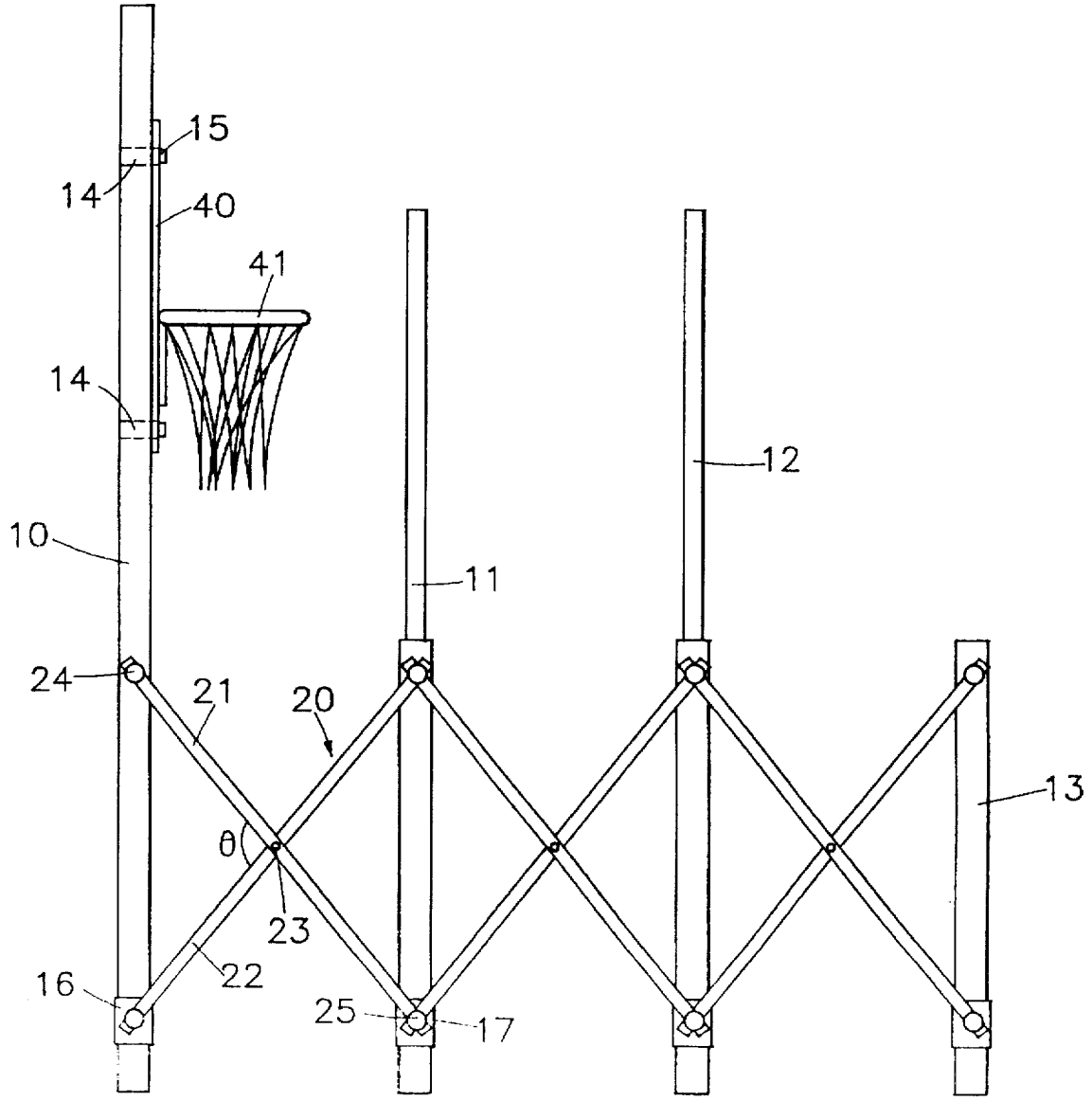
FIG. 3 is a side view of the collapsible support unit of FIG. 2.
Figure 4:
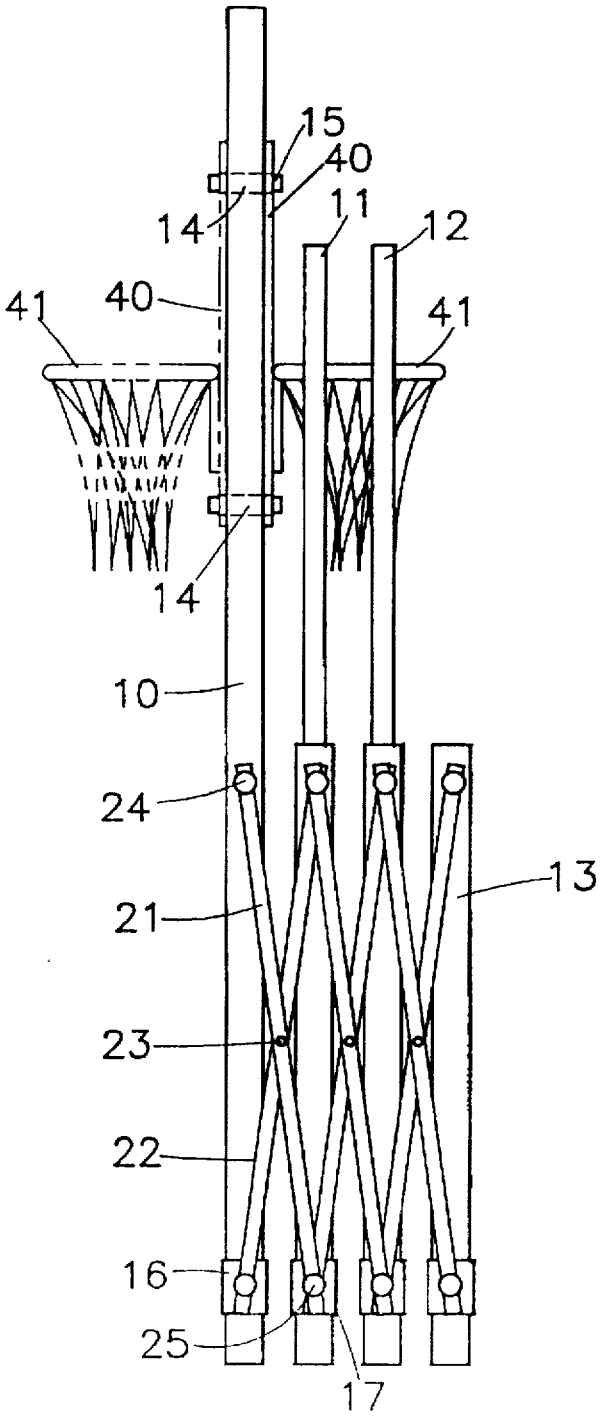
FIG. 4 is a side view of the collapsible support unit of FIG. 2 when it is collapsed for storage.

Referring to FIGS. 1 through 3, the collapsible support unit for basketball basket according to the present invention comprises of a main upright frame 10, a plurality of auxiliary upright frames 11, 12, 13, a plurality of extendable linkage units 20, and a net 30. The main upright frame 10 and auxiliary upright frames 11, 12, 13 are constructed by metal or hard plastic tubes. The main and auxiliary upright frames 10, 11, 12, 13 are each composed of tubes arranged substantially in a U-shaped. The main upright frame 10 is used to support a backboard 40 used to mount a basket 41. The backboard 40 is fixed near the top of the main upright frame 10 by means of threaded bolts 14 (shown in FIG. 3) and nuts 15. The backboard 40 can be mounted on either sides of the main upright frame 10 as illustrated in FIG. 4.

The main upright frame 10 and auxiliary upright frames 11, 12, 13 are arranged in a row and each coupled to the neighboring one or ones by means of one extendable linkage unit 20. Each extendable linkage unit 20 is composed of two linkage bars, a first linkage bar 21 and a second linkage bar 22, which are pivotally coupled by means of a pin 23 to each other at the middle point thereof. Taking the extendable linkage unit 20 between the main upright frame 10 and the auxiliary upright frame 11 as example, the first linkage bar 21 thereof has a top end pivotally linked to a fixed position on the main upright frame 10 and a bottom end pivotally linked to a sliding tube 17 which sleeves the auxiliary upright frame 11, and similarly, the second linkage bar 22 has a top end pivotally linked to a fixed position on the auxiliary upright frame 11 and a bottom end pivotally linked to a sliding tube 16 which sleeves the main upright frame 10. The other extendable linkage units are arranged in a similar manner.

When the auxiliary upright frame 11 is pushed toward the main upright frame 10, the first linkage bar 21 will has its bottom end slide toward the bottom of the auxiliary upright frame 11 along with the sliding tube 17, and similarly the second linkage bar 22 will has its bottom end slide toward the bottom of the main upright frame 10 along with the sliding tube 16, thus allowing the auxiliary upright frame 11 to be collapsed to the main upright frame 10. The same extendable linkage unit is provided between the auxiliary upright frames 11, 12 and between the auxiliary upright frames 12, 13, so that by the same mechanism all the auxiliary upright frames 11, 12, 13 can be collapsed to the main upright frame 10 simply by pushing slightly forcibly by hand the outermost auxiliary upright frame 13 toward the main upright frame 10.

As shown in FIG. 1, the net 30 is attached to the top sections of the main upright frame 10 and auxiliary upright frames 11, 12, 13 on both sides of the basket 41, thus forming an enclosure that prevents the ball from bouncing wayward to the sides. To provide a path for the ball caught in the enclosure to roll back to the player, there is provided a rolling path which is embodied by a flexible piece 31 such as a fabric piece or a plastic piece extending from the bottom of the backboard 40 at a declined angle downward to the top of the auxiliary upright frame 13. The declined arrangement of the flexible piece 31 allows the ball to roll down back to the player after a shot is made at the basket 41. A stopping member 32 is further provided on the auxiliary upright frame 13 at the end of the flexible piece 31 so as to stop the ball (illustrated in dotted line 50 in FIG. 1) when the ball bounces and rolls back from the backboard 40.

In use, the collapsible support unit can be extended to a suitable length as the player wishes by pulling the auxiliary upright frame 13 away from the main upright frame 10. This allows the player to practice shooting the ball at the basket 41 at various distances. After making a shot, the ball can always be confined within the enclosure defined by the net 30 so that the ball would not bounce wayward to the sides, and then the flexible piece 31 provides a path that allows the ball to roll back to the player. The player thus can practice making shots continually without being interrupted by having to chase the ball all around the court after one shot is made.

Referring further to FIG. 4, the collapsible support unit also can have its basket 41 mounted on the other side of the main upright frame 10 so that it can be used on a playground where no baskets are provided for a group of players to play a basketball game.

When not in use, the collapsible support unit can be collapsed by pushing the auxiliary upright frame 13 toward the main upright frame 10 as illustrated in FIG. 4. In doing this, since the net 30 and the flexible piece 31 are flexible, they can be collapsed along with the auxiliary upright frames 11, 12, 13 without having to remove them first. The collapsible support unit of the present invention is thus not only easy to extend for practice or play, but also easy to collapse for storage.

The invention has been described using exemplary preferred embodiments. However, it is to be understood that the scope of the invention is not limited to the disclosed embodiments. To the contrary, it is intended to cover various modifications and similar arrangements. The scope of the claims, therefore, should be accorded the broadest interpretation so as to encompass all such modifications and similar arrangements.

What is claimed is:

1. A collapsible support unit for basketball basket, comprising:

(a) a backboard mounted with a basket;

(b) a main upright frame for supporting said backboard;

(c) a plurality of auxiliary upright frames arranged in a row with said main upright frame;

(d) a plurality of extendable linkage units, each being coupled between said main and auxiliary upright frames, each extendable linkage unit including a first linkage bar and a second linkage bar which are pivotally coupled by means of a pin to each other substantially at the middle point thereof, said first linkage bar having a top end pivotally linked to a fixed position on one of said main and auxiliary upright frames and a bottom end pivotally linked to a sliding tube which sleeves one neighboring upright frame, and said second linkage bar having a top end pivotally linked to a fixed position on said one neighboring upright frame and a bottom end pivotally linked to a sliding tube which sleeves said one of said main and auxiliary upright frames;

(e) an enclosure formed around said basket; and (f) a ball rolling path extending from the bottom of said backboard at a declined angle downward to the top of the outermost auxiliary upright frame.

2. The collapsible support unit of claim 1, wherein said basket is mounted to said backboard by means of threaded bolts and nuts.

3. The collapsible support unit of claim 1, wherein said enclosure is defined by a net attached to said main and auxiliary upright frames.

4. The collapsible support unit of claim 1, wherein said ball rolling path is a flexible piece.

* * * * *